US007463852B2

(12) United States Patent
Yoshida et al.

(10) Patent No.: US 7,463,852 B2
(45) Date of Patent: Dec. 9, 2008

(54) IMAGE FORMING APPARATUS HAVING A DEVELOPER CONVEYING SYSTEM AND ASSOCIATED METHODOLOGY

(75) Inventors: Keiichi Yoshida, Kawasaki (JP); Yoshio Hattori, Kawasaki (JP); Shinichi Kawahara, Tokyo (JP); Takatsugu Fujishiro, Tokyo (JP); Shuji Tanaka, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 250 days.

(21) Appl. No.: 11/543,830

(22) Filed: Oct. 6, 2006

(65) Prior Publication Data

US 2007/0081832 A1 Apr. 12, 2007

(30) Foreign Application Priority Data

Oct. 7, 2005 (JP) ..... 2005-295098

(51) Int. Cl.
*G03G 15/08* (2006.01)

(52) U.S. Cl. ..... 399/254; 399/256

(58) Field of Classification Search ..... 399/107, 399/119, 120, 252, 253, 254, 256; 222/DIG. 1
See application file for complete search history.

(56) References Cited

U.S. PATENT DOCUMENTS 5,887,224 A * 3/1999 Mizuishi et al. ..... 399/62
5,950,056 A * 9/1999 Hamamichi et al. ..... 399/256
6,360,066 B1 * 3/2002 Kawahito et al. ..... 399/254
6,366,755 B1 * 4/2002 Takashima ..... 399/254
6,687,478 B2 * 2/2004 Sugita et al. ..... 399/258

FOREIGN PATENT DOCUMENTS

| | | |
|---|---|---|
| JP | 09-197782 | 7/1997 |
| JP | 10-221937 | 8/1998 |
| JP | 11-024380 | 1/1999 |
| JP | 11-143192 | 5/1999 |
| JP | 2002-287472 | 10/2002 |
| JP | 2003-057929 | 2/2003 |
| JP | 2004-191768 | 7/2004 |
| JP | 2005-017872 | 1/2005 |

* cited by examiner

*Primary Examiner*—Hoan H Tran
(74) *Attorney, Agent, or Firm*—Oblon, Spivak, McClelland, Maier & Neustadt, P.C.

(57) ABSTRACT

An image forming apparatus includes an image carrier configured to form a latent image and a development unit including a development member configured to develop the latent image forming on the image carrier with a developer, and a plurality of conveying members each including at least one spiral vane and configured to rotate around a spiral axis of the spiral vane to revolve and transfer the developer around the spiral axis in a direction along the spiral axis, the plurality of conveying members configured to transfer the developer sequentially from a conveying member to an adjacent conveying member and including a first conveying member arranged at a position closest to the development member to supply developer to the development member, wherein a number of the spiral vanes of the first conveying member are at least two and is also greater than the number of spiral vanes in the remaining conveying members.

20 Claims, 9 Drawing Sheets

IMAGE FORMING APPARATUS HAVING A DEVELOPER CONVEYING SYSTEM AND ASSOCIATED METHODOLOGY

BACKGROUND OF THE INVENTION

The present invention relates to an image forming apparatus, and more particularly to an image forming apparatus which is capable of stably and efficiently conveying developer.

The "background" description provided herein is for the purpose of generally presenting the context of the invention. Work of the presently named inventors, to the extent it is described in this background section, as well as aspects of the description which may not otherwise qualify as prior art at the time of filing, are neither expressly or impliedly admitted as prior art against the present inventions.

Background image forming apparatuses, such as printers, facsimiles, copiers, and multifunction apparatuses which print, fax, copy, and so on generally use an electrophotographic process for image forming. Such background image forming apparatuses include a development unit which develops a latent image formed on an image carrier, such as a photosensitive drum. In the development unit, developer is conveyed to develop the image.

The development unit generally includes a screw member having a spiral shape to convey developer. The developer is conveyed along the axis of the screw member by rotating around a shaft center of the screw member.

A background development unit includes first and second agitating screws and a development roller. The first and second agitating screws are arranged in a developer storage and include projected spiral vanes around a shaft member of the agitating screw to agitate and convey the developer. The development roller is arranged in a development unit located next to the developer storage. The development roller conveys the latent image to a position the image carrier faces by the rotation of the development roller and develops the latent image with the developer.

A partition plate may or may not be arranged between the developer storage and the development unit. The development roller in the development unit and the second agitating screw in the developer storage are arranged to face each other with each circumference keeping a parallel positional relationship with a predetermined distance.

In the developer storage, first and second storage compartments are separately formed with a partition wall. The second agitating screw is arranged in the second storage compartment located closer to the development unit. The first agitating screw is arranged in the first storage compartment located on the far side of the development unit.

The developer in the first storage compartment is conveyed in a shaft axis direction of the first agitating screw by rotating around a shaft center of the first agitating screw. The developer is conveyed to an end of the first agitating screw. The developer is transferred into the second storage compartment from the first storage compartment through a communication hole.

Developer is conveyed in the second storage compartment by the rotation of the second agitating screw, part of the developer is pumped up by the development roller to contribute to the development and is returned to the second agitating screw from the development roller again. When the developer is conveyed to an end of the second agitating screw, the developer is transferred into the first storage compartment from the second storage compartment through a communication hole.

In this configuration, an unevenness of development concentration may occur because the surface of the developer being conveyed by the second agitating screw is undulated. More specifically, in a cross section of the second agitating screw, the shaft member has a projection of spiral vanes from part of an outer border of the rounded shaft member. The projection is rotated around the shaft member in accordance with the rotation of the shaft member. While the projection is moving from a farthest position to a closest position with respect to the development roller, the developer is pushed to the development roller and the surface of the developer is lifted up gradually in a direction to the development roller. The amount of developer in the region between the second agitating screw and the development roller is increased and the developer concentration is also increased.

Meanwhile, while the projection is moving from the closest position to the farthest position with respect to the development roller, the surface of the developer falls down gradually because the developer is moved in the same direction as the movement of the projection. The amount of developer in the region between the second agitating screw and the development roller is decreased and the developer concentration is also decreased.

The lifting-up and falling-down of the developer surface occurs during the rotation phase because the projection of the spiral vane is formed to have a spiral shape in a direction of the shaft member. As a result, an unevenness of development concentration may occur in accordance with the surface undulation of the developer in the direction of the screw axis.

Another background development unit includes a multiple thread screw having a plurality of spiral vanes, for example, a two spiral vane screw structure. Referring to a cross section of the two spiral vane screw, a first spiral vane projects from part of an outer border of the rounded shaft member. A second spiral vane projects at an opposite portion symmetrically, 180 degrees from the first spiral vane.

With respect to the two spiral vane screw, while one projection is moving from a farthest position to a closer position with respect to the development roller, the other projection is moving further from the development roller. The lifting-up of the developer is canceled due to the effect of a decrease of the developer surface, caused by the movement of the other spiral vane. As a result, an unevenness of development concentration due to the surface undulation of the developer is avoided.

However, the agitation of the developer during the conveyance may be weaker because the movement of the developer is limited within a region between the first and second vanes when using the two spiral vane screw. The agitation efficiency of the two spiral vane screw may be worse than the agitation efficiency of the single spiral vane screw. Therefore, some problems may occur due to the decrease of the agitation efficiency.

For example, when a two-component developer which includes toner and magnetic carrier is used, unevenness of the toner of the two-component developer occurs due to insufficient agitation and unevenness of the development concentration. When another two-component developer which includes toner and non magnetic carrier is used, the agitation of fully charged toner with partly charged toner may be insufficient. Thus, the partly charged toner may accumulate at a particular position and may cause a scumming phenomenon in which the partly charged toner is attached at non image area.

SUMMARY OF THE INVENTIONS

An image forming apparatus is provided which includes an image carrier configured to form a latent image and a development unit including a development member configured to develop the latent image forming on the image carrier with a developer, and a plurality of conveying members each including at least one spiral vane and configured to rotate around the spiral axis of the spiral vane, in order to revolve and transfer the developer around the spiral axis in a direction along the spiral axis, the plurality of conveying members configured to transfer the developer sequentially from one conveying member to the adjacent conveying member and including a first conveying member arranged at a position closest to the development member in order to supply developer to the development member, wherein a number of the spiral vanes of the first conveying member are at least two and are greater than the number of spiral vanes of the remaining conveying members.

Further, an image forming apparatus is provided in which the first conveying member includes an even number of spiral vanes, each of which is regularly arranged at a position with an angle of 360 degrees divided by the number of vanes.

It is to be understood that both the foregoing general description of the inventions and the following detailed description are exemplary, but not restrictive, of the inventions.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
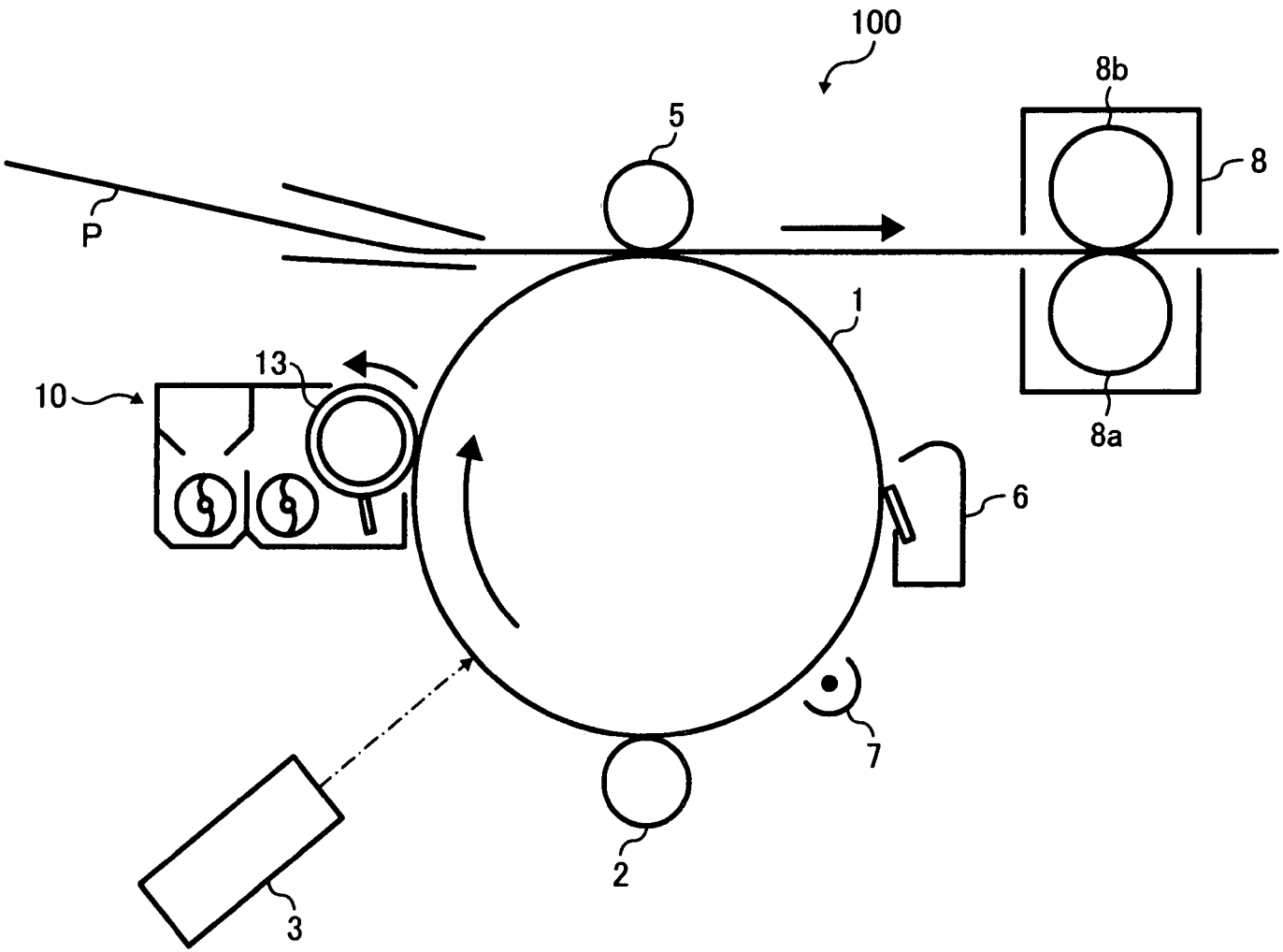
FIG. 1 illustrates an image forming apparatus according to an exemplary embodiment of the present inventions.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 3, a developing unit of an image forming apparatus according to an embodiment of the present invention is described.

FIG. 1 illustrates a printer 100 as an example of an image forming apparatus according to an embodiment of the present invention. As illustrated in FIG. 1, the printer 100 includes a photoreceptor 1 having a drum shape, and it works as an image carrier. The printer 100 includes a charging unit 2, a light-writing unit 3, a developing unit 10, a transfer unit 5, a drum cleaning unit 6 and a neutralization unit 7 around the photoreceptor 1. The printer 100 also includes a fixing unit 8 arranged on the right side of the transfer unit 5 in FIG. 1.

The photoreceptor 1 is driven to be rotated in a clockwise direction by a drive mechanism (not shown). The photoreceptor 1 includes a photosensitive layer formed of aluminum, etc, on a surface of a base pipe of the photoreceptor 1. The photoreceptor 1 is uniformly charged positively or negatively by the charging unit 2 during a rotation of the photoreceptor 1. Although, described relative to a printer throughout, those skilled in the art will recognize that multifunction devices are likewise embraced by the inventions described herein.

A portion of the surface of the photoreceptor 1 is exposed by a laser beam emitted from the light-writing unit 3 in accordance with light scan data based on image information sent by a computer (not shown), etc. A potential on the exposed surface is to be decreased.

By this processing, an electrostatic latent image is formed. The potential at a position exposed by the laser beam has a lower potential than the other area which is not exposed. The electrostatic latent image is passing through a development position which the developing unit 10 faces in accordance with the rotation of the photoreceptor 1. The electrostatic latent image is then rubbed with two-component developer which includes magnetic carrier and toner supplied by a developing sleeve 13 of the developing unit 10. The negatively charged toner of the two-component developer, for example, is adhered to the electrostatic latent image and forms a toner image at the development position.

At an upstream position, in the rotational direction of the photoreceptor 1, the photoreceptor 1 faces the transfer unit 5 to form a transfer position. After development, the toner image formed on the photoreceptor 1 is passed through the transfer position. A sheet of a recording medium P, is carried to the transfer position to match the toner image by adjusting the carrying timing. The toner image is transferred electrostatically onto the recording medium P by an electric field formed between the photoreceptor 1 and the transfer unit 5.

The recording medium P is adhered electrostatically to the photoreceptor 1 while the transferring process. After the transferring process, the recording medium P is released from the photoreceptor 1 in several ways, for example, weight and rigidity of the recording medium P, separation mechanism and so on. The recording medium P holding the toner image is then carried from the transfer position to the fixing unit 8.

In the fixing unit 8, a fixing nip is formed by the contact of a heat roller 8*a* with a pressuring roller 8*b*. The heat roller 8*a* includes a heat source inside (not shown) and is pushed by the pressuring roller 8*b*.

The heat roller 8*a* and the pressuring roller 8*b* are driven to be rotated so that each surface of the heat roller 8*a* and the pressuring roller 8*b* are moved in the same direction at the contacting point. The recording medium P carried to the fixing unit 8 is moved in a direction of the surface of the rollers by being held by the fixing nip. The toner image is fixed by the pressure and the heat of the fixing nip. After fixing, the recording medium P is output through a paper-output unit (not shown) from the printer 100.

While the surface of the photoreceptor 1 passes through a position the drum cleaning unit 6 faces, residual toner on the surface of the photoreceptor 1 is removed. The surface of the photoreceptor 1 is neutralized by the neutralization unit 7 and is then charged again uniformly to be initialized.

As shown in FIG. 1, a bias member such as a charging roller is employed as the charging unit 2. The charging roller faces the photoreceptor 1 and is rotated to be charged by applying charging bias voltage. However, noncontact charging members, such as a charger and so on may also be employed.

Similarly, as the light-writing unit 3, a light-writing unit which exposes LED (light emitting device) light from LED array may be employed so as to write an image. An ion injection method may also be employed to write the image instead of using light. As the transfer unit 5, a transfer belt and a transfer charger may also be employed. As the drum cleaning unit 6, a brush and a roller which are applied by the cleaning bias and are contacted to the photoreceptor 1 may also be employed.

A belt type photoreceptor may be employed as a photoreceptor. The photoreceptor 1, the charging unit 2, the developing unit 10 and drum cleaning unit 6 may be integrated in a process unit. The process unit includes at least developing unit 10. The process unit is detachably arranged in the main body of the printer 100.

Figure 2:
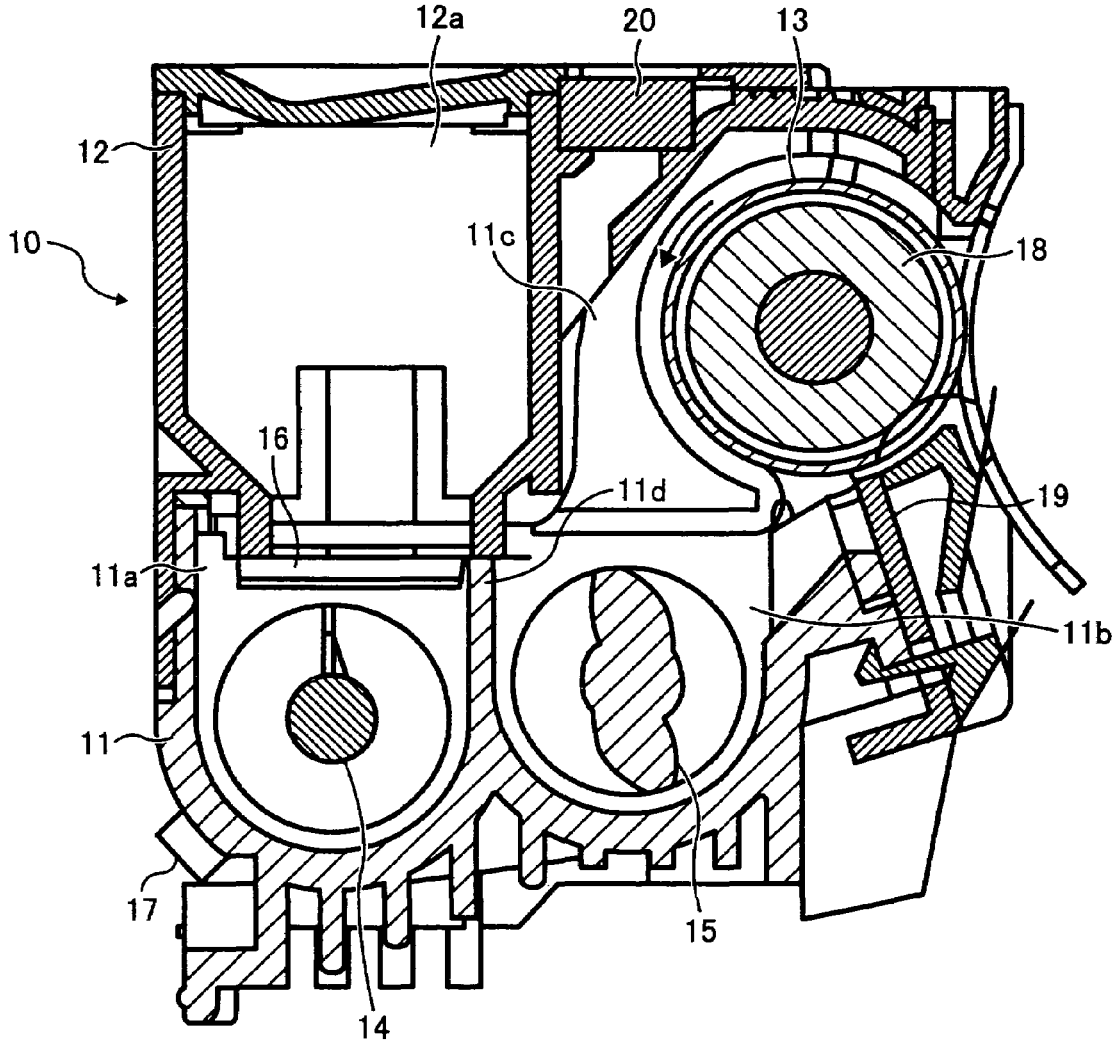
FIG. 2 illustrates a magnified view of the developing unit of FIG. 1.
Figure 3:
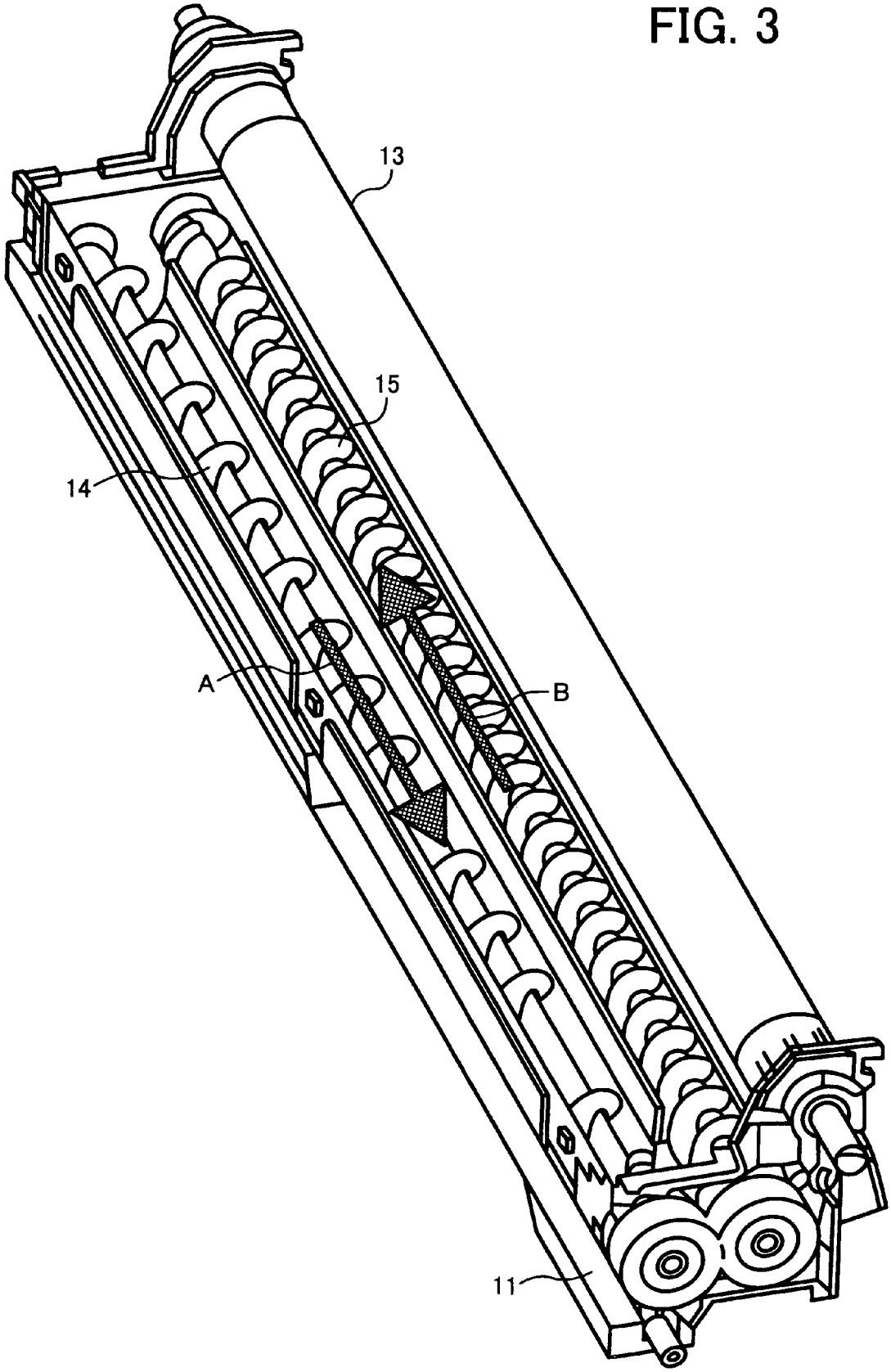
FIG. 3 illustrates an elevated perspective view of the lower case of the developing unit of FIG. 2.
Figure 4:
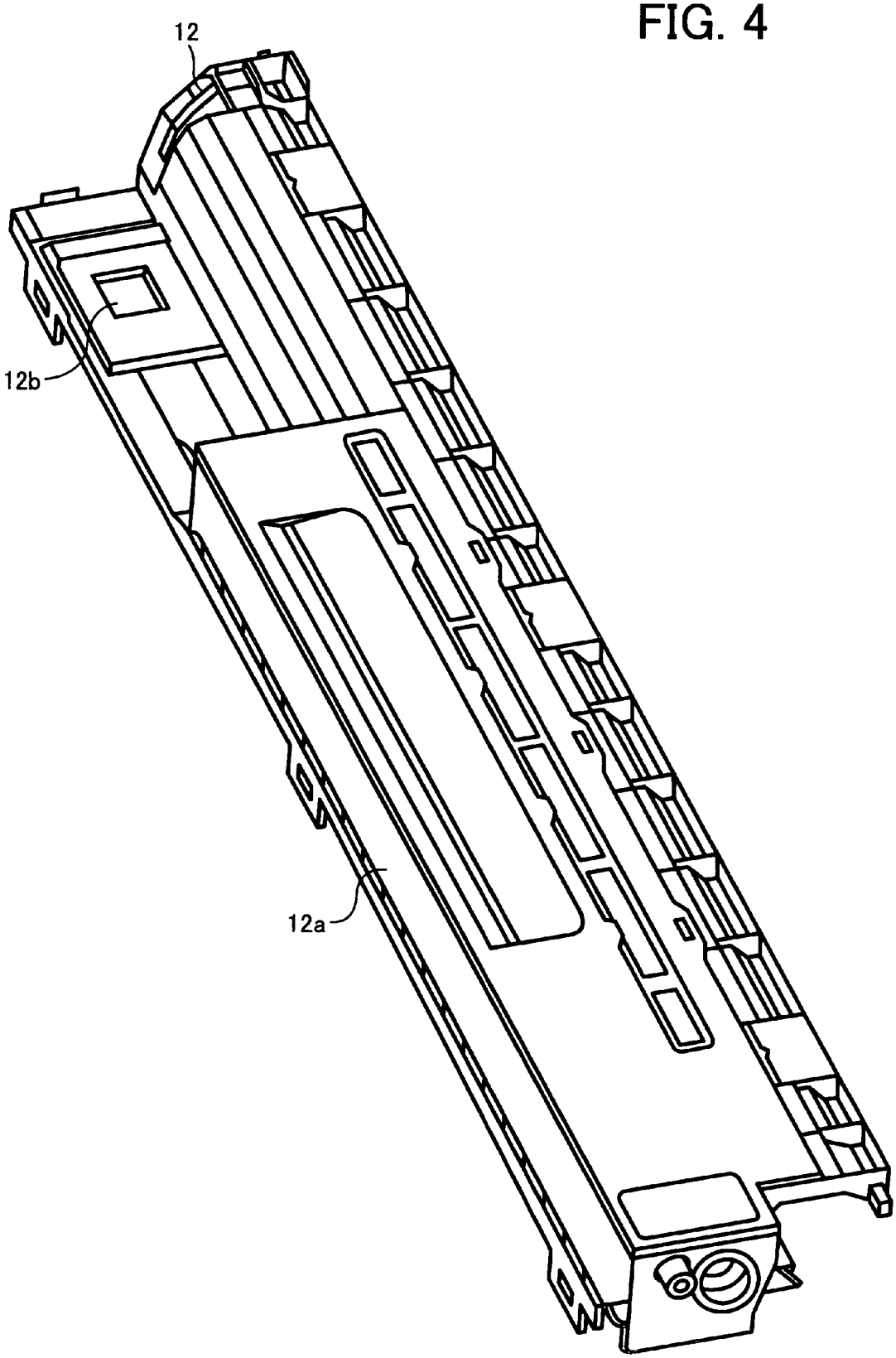
FIG. 4 illustrates an elevated perspective view of the upper case of the developing unit of FIG. 2.

FIG. 2 illustrates a magnified view of the developing unit 10. FIG. 3 illustrates an elevated perspective view of the lower case 11 of the developing unit 10. FIG. 4 illustrates an elevated perspective view of the upper case 12 of the developing unit 10. The casing of the developing unit 10 can be separated into two parts i.e., the lower case 11 and the upper case 12.

The lower case 11 includes a first storage 11*a*, a second storage 11*b* and development part 11*c*. The first and second storages 11*a* and 11*b* store the two-component developer. The development part 11*c* includes the developing sleeve 13. The upper case 12 is arranged above the first storage 11*a* of the lower case 11 and includes an initial developer storage 12*a*.

The first and the second storages 11*a* and 11*b* are partitioned by a partition wall 11*d*. In the first storage 11*a*, a first agitation screw 14 is a conveying screw to convey developer and is rotatably arranged. In the second storage 11*a*, a second agitation screw 15 is a supply-conveying screw to supply the developer to the development member and is rotatably arranged. A partition plate is not arranged between the second storage 11*b* and the development part 11*c* as shown in FIG. 3. The second agitation screw 15 and the developing sleeve 13 are arranged to face each other, keeping a parallel positional relationship.

On a sidewall of the development part 11*c* of the lower case 11, an opening is arranged as shown in FIG. 2. The developing sleeve 13 is driven to be rotated in a counterclockwise direction by a drive mechanism (not shown). Part of the circumference of the developing sleeve 13 is exposed to the opening while rotating.

A sealing film is attached between the initial developer storage 12*a* of the upper case 12 and the first storage 11*a* of the lower case 11 when the development unit 10 is shipped from factory. In the initial developer storage 12*a*, the initial developer is stored. Initial developer is two-component developer which includes toner and magnetic carrier. The initial developer has around 7 [weight %] of the toner concentration.

When the sealing film is pulled out by a user, the initial developer is dropped into the first storage 11*a* from the initial developer storage 12*a* by its own weight. In accordance with the rotation of the first conveying screw 14 driven by a drive mechanism (not shown), the initial developer is conveyed from backside to front side in the shaft direction. (as shown in FIG. 3) Connection holes are arranged on a partition wall 11*d* at an end of the backside and an end of the front side of the development unit 10.

The initial developer is conveyed to the end of the front side of FIG. 3 by the first conveying screw 14 and is carried from the first storage 11*a* to the second storage 11*b* through the connection hole.

Further, the initial developer is conveyed from the front side to the backside by the second conveying screw 15 driven to be rotated by a drive mechanism (not shown). (as shown by an arrow B in FIG. 3) At the end of the backside in FIG. 3, the initial developer is carried back from the second storage 11*b* to the first storage 11*a* through the connection hole. Thus, the developer is conveyed circularly between the first and second storages 11*a* and 11*b* in the development unit 10. The initial developer is circulated around all the developer storage by the circular movement.

In the cylindrically shaped developing sleeve 13 is a magnet roller 18, which includes a plurality of fixed magnetic poles in a circumferential direction arranged in the developing sleeve 13 as to not rotate. When a printing operation is started, some of the two-component developer, which is being conveyed in the second storage 11*b* by the second conveying screw 15, is attracted onto the surface of the developing sleeve 13 by a pumping-up magnetic force of the magnet roller 18.

Part of the two-component developer is pumped up from the second storage 11*b*, while the surface of the developing sleeve 13 is moved in a counterclockwise direction. The two-component developer is limited to have a predetermined thickness by a doctor blade 19 which is arranged to face the developing sleeve 13 with a predetermined gap. The toner of the two-component developer is consumed by the development process while passing through the development position in accordance with the rotation of the developing sleeve 13.

After the development process, the two-component developer on the surface of the developing sleeve 13 is returned back to the lower case 11. The two-component developer is removed from the developing sleeve 13 and is carried back into the second storage 11*b* by two repelling magnetic forces from poles of magnets repelling each other.

The toner concentration of the two-component developer decreases after the development process. The two-component developer passes through a toner concentration sensor 17, arranged on the base wall of the lower case 11, while the two-component developer is conveyed from the second storage 11*b* to the first storage 11*a*. The toner concentration sensor 17 includes a permeability sensor and outputs a voltage signal corresponding to the magnetic permeability of the two-component developer.

There is a strong relationship between the toner concentration and the magnetic permeability of the two-component developer. Therefore, the toner concentration of the two-component developer can be detected from the measurement of the magnetic permeability by the toner concentration sensor 17.

In FIG. 4, a part of the upper case 12 is formed by the upper wall of the first storage 11*a* of FIG. 2. A toner supply hole 12*b* is situated on a portion of the upper wall. The printer 100 includes a toner cartridge and a toner conveying mechanism which conveys the toner to the development unit 10 and supplies the toner into the first storage 11*a* through the toner supply hole 12*b*.

Further, a control circuit is arranged to perform drive control of the toner conveying mechanism in accordance with the observed results of the toner concentration of the two-component developer. The toner is supplied into the first storage 11*a* by the drive control of the control circuit if necessary so that the toner concentration is maintained within a predetermined range.

The upper case 12 includes an exhaust opening and a filter 20. The exhaust opening outputs gas from the development part 11*c* when gas pressure in the development part 11*c* rises above a predetermined value. The filter covers the exhaust opening.

In the development part 11*c*, gas is generated by the rotation of the developing sleeve 13. By the exhaust opening, the gas around the developing sleeve 13 is output through the filter 20. Thus, the gas stored in the area between the developing sleeve 13 and the image carrier is brought into development part 11*c* from the opening of the casing by making gas flow so that toner is prevented from flying into the printer 100 from the developing sleeve 13.

Figure 5:
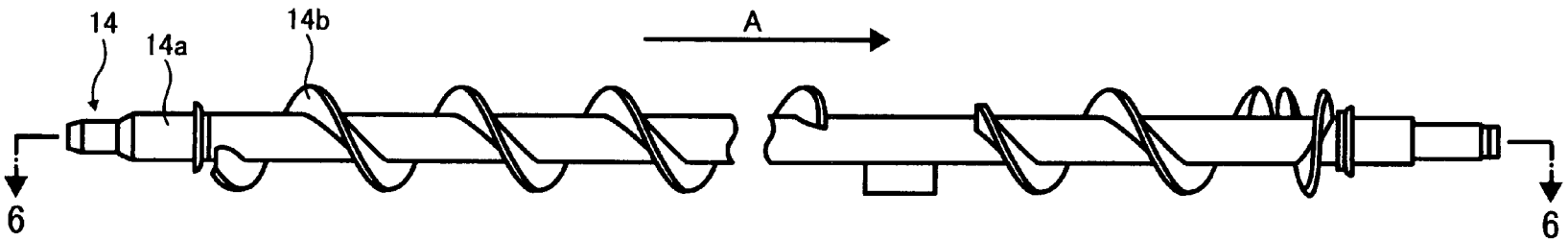
FIG. 5 illustrates a side view of the first conveying screw.
Figure 6:
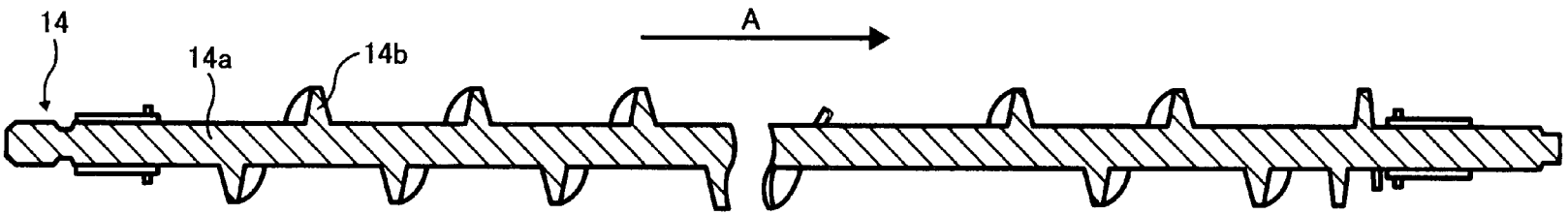
FIG. 6 illustrates a cross-sectional view of the first conveying screw of FIG. 2.

FIG. 5 illustrates a side view of the first conveying screw 14. FIG. 6 illustrates a cross-sectional view of the first conveying screw 14. The first conveying screw 14 is a conveying mechanism and includes a shaft member 14*a* and a spiral vane 14*b*. The shaft member 14*a* has a round bar shape and is rotated by a drive mechanism (not shown). The spiral vane 14*b* has a spiral member projecting from the surface of the shaft member 14*a*.

The two-component developer is conveyed in a direction shown by an arrow A by rotating around the shaft member 14*a* in accordance with the rotation of the spiral vane 14*b* around the shaft member 14*a*. A center of the shaft member 14*a* is equal to a center of the spiral-vane 14*b*. When the two-component developer is conveyed to the end of the first conveying screw, the two-component developer is then transferred to the second conveying screw. The first conveying screw 14 is a single vane screw which has one spiral vane 14*b* on the circumference of the shaft member 14*a*.

Figure 7:
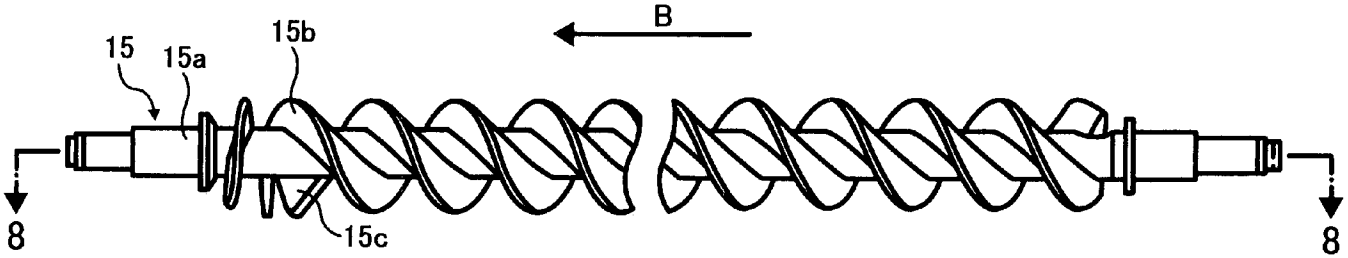
FIG. 7 illustrates a side view of the second conveying screw of FIG. 2.
Figure 8:
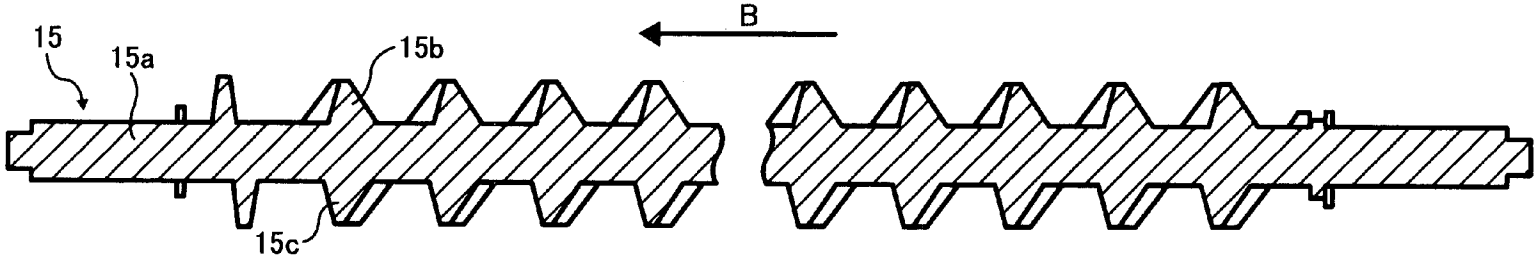
FIG. 8 illustrates a cross-sectional view of the second conveying screw of FIG. 2.

FIG. 7 illustrates a side view of the second conveying screw 15. FIG. 8 illustrates a cross-sectional view of the second conveying screw 15. The second conveying screw 15 is a conveying mechanism which supplies two-component developer to the developing sleeve (not shown).

The second conveying screw 15 includes a shaft member 15*a* and spiral vanes 15*b* and 15*c*. The shaft member 15*a* has a round bar shape and is rotated by a drive mechanism (not shown). The spiral vanes 15*b* and 15*c* have spiral members projecting from the surface of the shaft member 15*a*. The spiral vanes 15*b* and 15*c* form two threads of a spiral vane screw structure. The vanes are arranged on the shaft member 15*a* to have a phase difference of 180 degrees.

The two-component developer is conveyed in a direction shown by an arrow B by rotating around the shaft member 15*a*. When the two-component developer is conveyed to the end of the second conveying screw, the two-component developer is transferred to the first conveying screw (not shown). The second conveying screw 15 is a conveying member to convey the developer and is closer to the sleeve 13 of the development member than the first conveying screw, as shown in FIG. 2.

Figure 9:
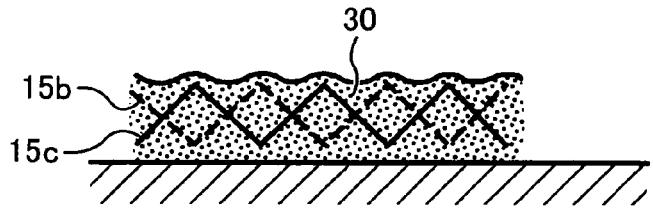
FIG. 9 illustrates a schematic of the second conveying screw with a surface of the developer of FIG. 2.

The second conveying screw 15 has a two threaded spiral vane screw structure as shown in FIGS. 7 and 8. This structure causes the two-component developer to be rotated around the shaft member 15*a* by the spiral vanes 15*b* and 15*c*, which have a 180 degree phase difference from each other. During the rotation, the lifting-up and falling-down of the surface of the two-component developer is canceled by the two different movements of the undulation having a 180 degree phase shift, so as to have a rather flat surface with a smaller amplitude of the developer surface as shown in FIG. 9. Thus, the surface undulation of the two-component developer 30 is avoided. Namely, the occurrence of the unevenness of development concentration due to the surface undulation of the two-component developer (screw pitch unevenness) can be avoided.

Meanwhile, a single vane structure screw having a smaller spiral pitch than a normal spiral pitch may be employed to reduce the surface undulation of the two-component developer. However, the developer conveying speed in the direction of the shaft may be decreased by the reduction of the screw pitch. Due to the decrease of the developer conveying speed, the amount of two-component developer conveyed may lose balance among the plurality of conveying screws in the developer storage. The amount of toner supplied may not be enough to compensate for the toner amount consumed by the development process.

As for the two spiral vane screw, the length of the spiral pitch of the spiral vanes 15*b* and 15*c* is half the length of the spiral pitch of the single spiral vane screw. But, each spiral pitch of the two spiral vane screw is the same length as the spiral pitch of the single spiral vane screw. The two spiral vane screw has approximately the same developer conveying speed as the developer conveying speed of the single spiral vane screw, so that there is no degradation in the amount of developer conveyed, caused by the smaller spiral pitch.

Figure 10:
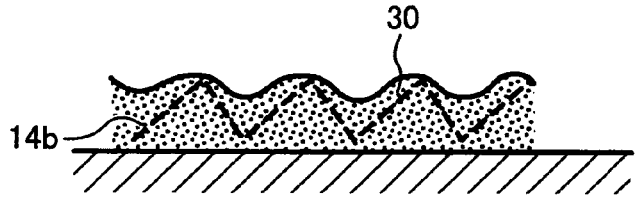
FIG. 10 illustrates a schematic of the first conveying screw with a surface of the developer of FIG. 2.

The first conveying screw 14 shown in FIGS. 5 and 6 makes a relatively large undulation on the surface of the two-component developer 30 as shown in FIG. 10. However, the first conveying screw 14 is not the mechanism to convey the two-component developer to the development member. Therefore, the large undulation by the first conveying screw 14 does not cause the unevenness of the development concentration. Rather, it may be of merit that the two-component developer 30 is fully agitated by the large undulation and is transferred to the second conveying screw.

In an exemplary embodiment of the printer 100, the unevenness of the development concentration due to the undulation of the developer surface can be avoided by employing a two spiral vane screw as the second conveying screw which supplies the two-component developer directly to the development member. Further, a variety of problems due to the insufficient agitation of the two-component developer can be avoided by employing the single spiral vane screw as the first conveying screw as another conveying mechanism for the two-component developer.

The first conveying screw is not necessarily a single spiral vane screw. The first conveying screw may have less vanes than the second conveying screw. Further, the second conveying screw is not necessarily a two spiral vane screw. The second conveying screw may have any even number of spiral vanes. Each spiral vane is separately arranged with an angle of 360 degrees divided by the number of spiral vanes. Referring to the cross section, a projection of a spiral vane is positioned symmetrically with a projection of the other spiral vane. The lifting-up and falling-down of the surface of the two-component developer is canceled by the rotation of the two spiral vanes.

Figure 11:
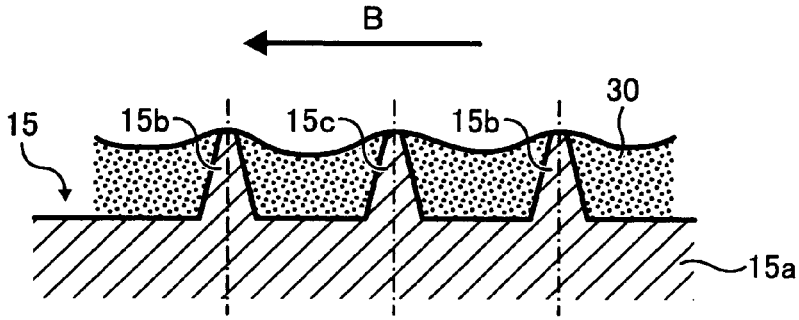
FIG. 11 illustrates a magnified view of a first example of the second conveying screw of FIG. 2.
Figure 12:
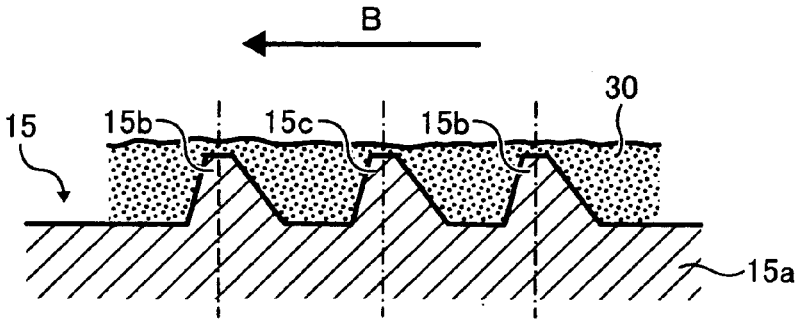
FIG. 12 illustrates a magnified view of a second example of the second conveying screw of FIG. 2.

FIG. 11 illustrates a magnified view of a first example of the second conveying screw 15. FIG. 12 illustrates a magnified view of a second example of the second conveying screw 15. The arrow B in FIGS. 11 and 12 shows the direction of conveyed two-component developer. Regarding the spiral vanes 15*b* and 15*c* of the first example of the second conveying screw 15, a cross-sectional profile of the spiral vane has an axisymmetrical shape with respect to the upstream and downstream conveyance of the developer.

More specifically, the cross-sectional profile of the spiral vane has a trapezoidal shape. The right and left cross-sectional profiles of the spiral vane are symmetric with respect to a line drawn from a middle point of an upper base perpendicular towards the shaft member 15*a* shown by an alternate long and short dash line.

Meanwhile, regarding the spiral vanes 15*b* and 15*c* of the second example of the second conveying screw 15, a cross-sectional profile of the spiral vane has an asymmetrical shape with respect to upstream and downstream conveyance of the developer. More specifically, the cross-sectional profile of the spiral vane has a trapezoidal shape. The right and left cross-sectional profiles of the spiral vane are asymmetric with respect to a line drawn from a middle point of an upper base perpendicular towards the shaft member 15*a* shown by an alternate long and short dash line. As shown in FIG. 12, the cross-sectional profile on the right side which is upstream of the direction developer is conveyed, is larger than the cross-sectional profile on the left side which is downstream of the direction in which developer is conveyed.

Referring to FIG. 11, the surface profile of the two-component developer 30 drops slightly at a region between the first and second spiral vanes 15*b* and 15*c* of the first example of the second conveying screw 15. Meanwhile, referring to FIG. 12, the surface profile of the two-component developer 30 is almost flat at a region between the first and second spiral vanes 15*b* and 15*c* of the second example of the second conveying screw 15. This is because the larger cross-sectional profile of the vane on the right side provides a force to lift up the two-component developer 30 existing between the first and second spiral vanes 15*b* and 15*c*.

Therefore, the printer 100 according to the first exemplary embodiment employs the second example of the second conveying screw 15 as shown in FIG. 12. As a result, it is possible to avoid the occurrence of the surface undulation of the two-component developer.

A second conveying screw 15 of the printer according to a second exemplary embodiment employs the following dimensional relationship. Namely, a diameter of the shaft member 15*a* (for example, 6 mm) is larger than a diameter of the shaft member 14*a* (for example, 5 mm) of the first conveying screw 14. Diameters of the first and second spiral vanes 15*b* and 15*c* are the same as the diameter of the spiral vane of the first conveying screw 14. A developer amount held by the second conveying screw 15 is smaller than the developer amount held by the first conveying screw 14 because of the larger diameter of the shaft member 15*a*.

The volume of two-component developer existing in the upper part of the screw in the second storage 11*b* is larger than the volume existing in the first storage 11*a*. As a result, it is possible to avoid the occurrence of surface undulation of the two-component developer. Further, the rigidity of the second conveying screw 15 is increased because of the larger diameter of the shaft member 15*a*. As a result, it becomes easier to avoid bending of the second conveying screw 15. Moreover, undulation of the two-component developer caused by an eccentric rotation due to the bending may be reduced.

Figure 13:
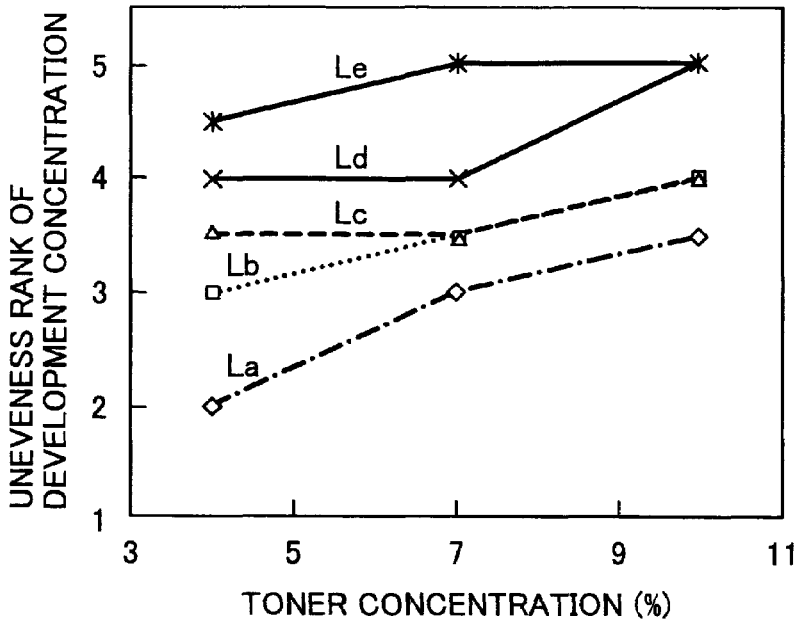
FIG. 13 is a graph of an unevenness rank of the development concentration versus toner concentration of the two-component developer.

FIG. 13 is a graph representing the unevenness rank of the developer concentration versus toner concentration of the two-component developer using a variety of types of second conveying screws 15. This graph shows the measured results based on an experiment of printing using a similar printer, shown in FIG. 1, mounting a variety of different types of second conveying screws 15.

The unevenness rank of the developer concentration is determined based on observations of printed images. Smaller values of unevenness rank of the developer concentration represent larger unevenness of the developer concentration. The curved line La represents the measured result when the second conveying screw 15 was a single spiral vane screw. A curved line Lb represents a measured result when the second conveying screw 15 was a single spiral vane screw having an asymmetrical shape with a cross-sectional profile as in the first example.

The curved line Lc represents the measured result when a second conveying screw 15 is the two spiral vane screw. The curved line Ld represents the measured result when a second conveying screw 15 is the two spiral vane screw having an asymmetrical shape with a cross-sectional profile as in the first example.

The curved line Le represents the measured result when a second conveying screw 15 is the two spiral vane screw, having an asymmetrical shape with a cross-sectional profile in which the diameter of the shaft member is larger than the diameter of the shaft member of the first conveying screw 14. (the diameter of the shaft member of the first conveying screw is 5 mm and the diameter of the shaft member of the second convey screw is 6 mm) In all the cases La to Le, all the spiral vanes have the same spiral screw pitch.

Referring to FIG. 13, it is found that the unevenness of the development concentration can easily occur in any type of second conveying screw 15 if the toner concentration is a low value. When the toner concentration is a low value, the volume of two-component developer becomes small. More specifically, a volume of two-component developer at the upper part is smaller than the average concentration of the two-component developer. As a result, surface undulation of the two-component developer can easily be generated.

Comparing curved lines La and Lc, it is confirmed that the surface undulation of the two-component developer can be reduced by increasing the number of vanes. Comparing curved lines Lc and Ld, it is confirmed that the surface undulation of the two-component developer can be further reduced by using a cross-sectional profile of asymmetrical vanes as in the first example of the second conveying screw.

Comparing curved lines Ld and Le, it is confirmed that the surface undulation of the two-component developer can be reduced further by having a shaft member with a larger diameter than that of the first conveying screw 14 and a cross-sectional profile of asymmetrical vanes.

A supply-conveying screw (second conveying screw) according to a third exemplary embodiment employs a multiple spiral vane structure screw. The pitch of the spiral vanes of the multiple spiral vane structure screw in the direction of the shaft member is determined to be as small as 0.3 to 0.7 times the pitch of the spiral vane of the other conveying screws.

The pitch of the spiral vanes of the multiple spiral vane structure screw is defined as a pitch between projections of the spiral members. For example, the pitch of the spiral vane is the distance between projections of the first and second spiral members if it is the two spiral vane screw.

The pitch of the spiral vane of the other conveying screw is defined as a pitch of the single spiral vane if it is a single spiral vane screw. If it is the multiple spiral vane screw, the pitch of the spiral vanes of the multiple spiral vane structure screw is defined as a pitch in the direction of the shaft member between projections formed by each spiral vane.

In the third exemplary embodiment, the two conveying screws, i.e., the first and second conveying screws are employed. The pitch of the spiral vanes of the second conveying screw 15 having a two spiral vane screw structure is determined to be as small as 0.3 to 0.7 times the pitch of the spiral vane of the first conveying screw. For example, when the second conveying screw 15, having a pitch of 10 mm, is employed the first conveying screw 14 having a pitch of 20 mm may be employed. (0.5 times)

Thus, the pitch of the spiral vanes of the multiple spiral vane structure screw in a direction of the shaft member is determined to be as small as 0.3 to 0.7 times the pitch of the spiral vanes of the other conveying screw. The reasons for this will be described based on observations of experiments.

If the pitch of the spiral vane of the supply-conveying screw in the direction of the shaft member is set to be less than 0.3 times the pitch of the spiral vanes of the other conveying screw, the difference of the developer conveying speed between the supply-conveying screw and the other conveying screw becomes larger. The distribution of the two-component developer in the developer storage becomes dominant on one side.

Figure 16:
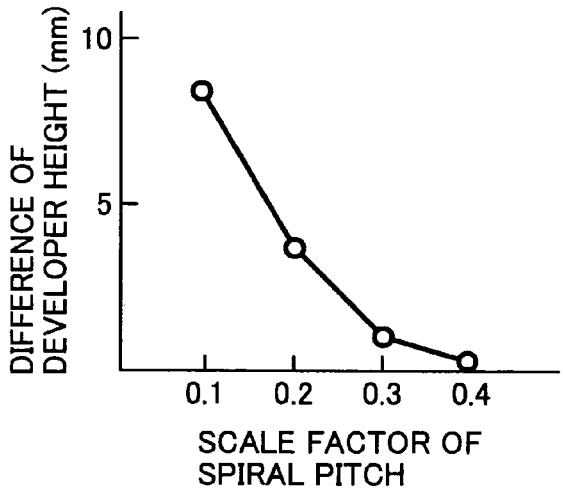
FIG. 16 is a graph representing height differences of the two-component developer at both ends of the first and second storage versus scale factor of spiral pitch of the supply-conveying screw to the other conveying screw.

FIG. 16 is a graph representing the difference in heighth between the two-component developer at both ends of the first and second storage 11*a* and 11*b* versus the scale factor of spiral pitch of the supply-conveying screw to the other conveying screw. As shown in FIG. 16, the height difference of the two-component developer is rapidly increased if the pitch of the spiral vane of the supply-conveying screw in a direction of the shaft member is set to be less than 0.3 times the pitch of the spiral vanes of the other conveying screw.

Experiments showed that it is not possible to avoid surface undulation of the two-component developer conveyed by the supply-convey screw if the pitch of the spiral vanes of the supply-convey screw in a direction of the shaft member is set to be larger than 0.7 times a pitch of the spiral vanes of the other conveying screw.

Figure 17:
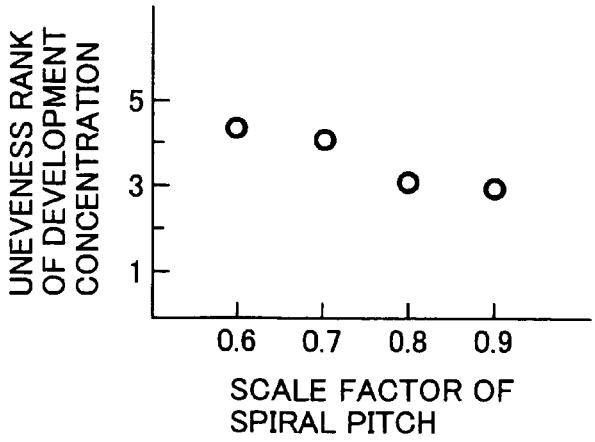
FIG. 17 is a graph of an unevenness rank of the development concentration of the printout image versus scale factor of spiral pitch of the supply-conveying screw to the other conveying screw.

FIG. 17 is a graph representing the unevenness rank of the development concentration of the printout image versus the scale factor of spiral pitch of the supply-conveying screw to the other conveying screw. The unevenness rank of the development concentration must be more than 3.5 to meet the tolerance level. Referring to FIG. 17, the unevenness of the development concentration may drop down below the tolerance level if the pitch of the spiral vanes of the supply-conveying screw in the direction of the shaft member is set to be larger than 0.7 times the pitch of the spiral vanes of the other conveying screw.

Figure 14:
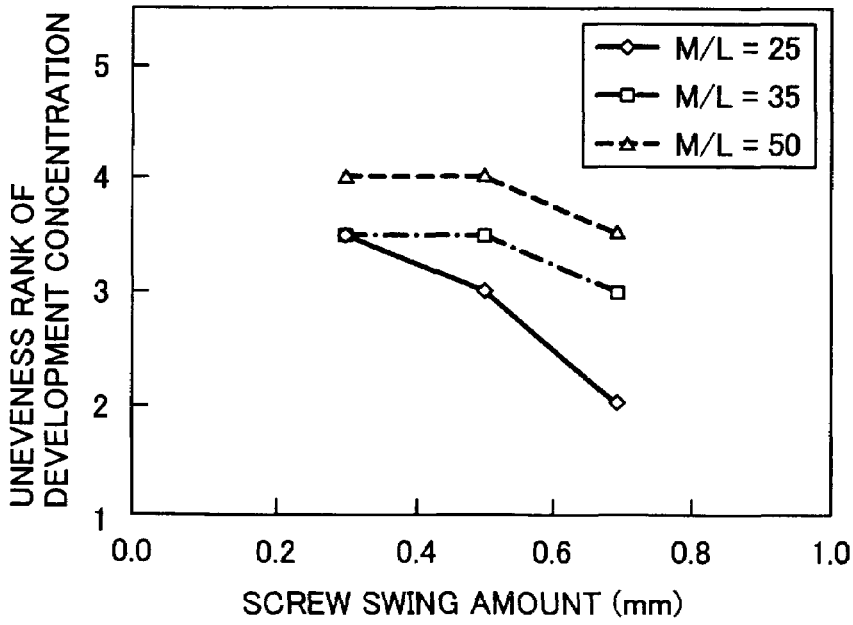
FIG. 14 is a graph of an unevenness rank of the development concentration versus swing amount of the second conveying screw.

FIG. 14 is a graph representing the unevenness rank of the developer concentration versus swing amount of the second conveying screw 15 with different combinations of ML ratio (M/L). The ML ratio is defined as a value of a bend elastic constant M (MPa) according to JIS K7171 divided by a length L of the second conveying screw 15 in the shaft direction.

The length L of the second conveying screw in the shaft direction is the distance between bearings which support the shaft member at both ends of the shaft member. The swing amount of the second conveying screw is the difference between the minimum and maximum trajectories of the outer circumference of the screw when the screw is rotated. It is not possible to form a second conveying screw with complete straightness. The second conveying screw is slightly bent due to accuracy limitations in manufacturing. The second conveying screw swings during the rotation of the second conveying screw due to the unstraightness of the second conveying screw. Further, the second conveying screw may be slightly bent due to a lack of rigidity and the centrifugal force when the second conveying screw is rotated. As a result, the second conveying screw swings due to the bending.

As shown in FIG. 14, unevenness of the developer concentration becomes worse when the ML ratio (M/L) of the second conveying screw 15 becomes small, i.e., the rigidity becomes low. The swinging amount is increased due to the bending caused by the centrifugal force if the rigidity of the second conveying screw 15 is low. The surface undulation of the two-component developer becomes large due to the increase of the swing amount of the second conveying screw 15.

The swing amount may be different among individual screws in FIG. 14 even when the screws have the same ML ratio (M/L). Each screw has a different bending amount at a state with no rotation due to the accuracy limitations of manufacturing in addition to the bending due to the centrifugal force.

The data of FIG. 14 includes experimental results using screws manufactured intentionally to have large bending. When the screw is manufactured with high accuracy, it may be possible to have a swing amount around 0.2 mm and to make the unevenness of the developer concentration within the tolerance level (3.5 or more), even if the ML ratio is 25. Therefore, the printer according to the fourth exemplary embodiment employs the second conveying screw 15 having a ML ratio of 25.

According to a fifth exemplary embodiment, the clearance between the edge of the spiral member of the supply-conveying member and the wall of a developer storage will be as described. The base wall of the first storage 11*a* includes the first conveying screw 14 and has a semicircular shape along a curvature of the spiral vanes of the first conveying screw 14. The base wall of the second storage 11*b* includes the second conveying screw 15 and also has a semicircular shape along a curvature of the spiral vanes of the second conveying screw 15.

The curvature radius of the second storage 11*b* (for example, 8 mm) is smaller than the curvature radius of the first storage 11*a* (for example, 8.5 mm) in the printer according to the second exemplary embodiment. The clearance between the edge of the spiral vanes of the second conveying screw 15 in the second storage 11*b* and the base wall of the second storage 11*b* is determined to be smaller than the clearance between the edge of the spiral vanes of the first conveying screw 14 and the base wall of the first conveying screw 14.

The thickness of the two-component developer at the upper part of the screw in the second storage 11*b* becomes larger than that in the first storage 11*a*. As a result, it is possible to avoid the occurrence of the surface undulation of the two-component developer.

Figure 15:
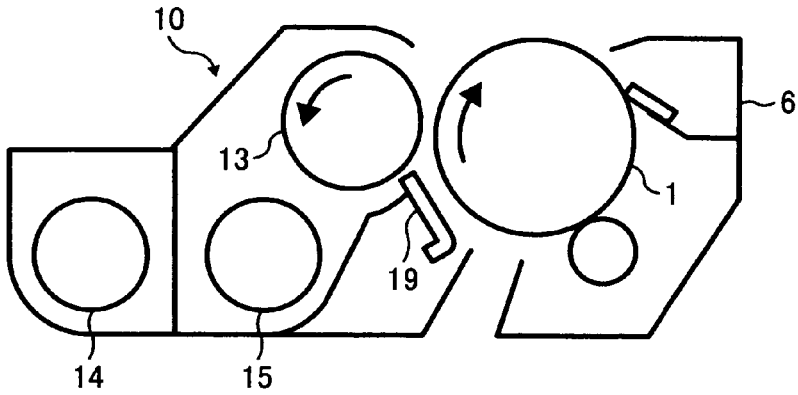
FIG. 15 illustrates a process unit according to an exemplary embodiment of the inventions.

In an exemplary embodiment, the printer which includes the development unit 10 employing the technology according to the exemplary embodiments of the present invention is described. However, the technology can be applied to any process unit which includes the development unit, for example, a process unit which includes the image carrier 1, the development unit 10 according to the exemplary embodiment and the drum cleaning unit 6 are integrated in one casing and is detachably arranged in the image forming apparatus as shown in FIG. 15.

In an exemplary embodiment, the conveying screw which includes projected spiral vanes around the shaft member is described. However, another type of conveying member can be employed, for example, a conveying member which includes separate parts such as spiral vanes in the middle part and a rotation shaft member attaching to the spiral vanes.

In an exemplary embodiment, the development unit using the two-component developer is described. However, it is possible to apply the technology to the development unit using single-component developer.

In an exemplary embodiment, the printer 100 having one development unit 10 to form a single color image is described. However, it is possible to apply the technology to the image forming apparatus having a plurality of development units to develop a latent image with different colors to form a full color image. There are several types of image forming apparatuses, for example, an image forming apparatus having a plurality of development units around an image carrier, so called revolver-development image forming apparatuses in which a plurality of development units rotate at a facing position of the development unit and an image forming apparatus having a process unit which includes an image carrier and a development unit.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application, No. 2005-295098 filed on Oct. 7, 2005 in the Japanese Patent Office, the entire contents of which are incorporated by reference herein.

What is claimed is:

1. An image forming apparatus, comprising:

an image carrier configured to form a latent image; and a development unit including a development member configured to develop the latent image forming on the image carrier with a developer, and a plurality of conveying members each including at least one spiral vane and configured to rotate around a spiral axis of the spiral vane to revolve and transfer the developer around the spiral axis in a direction along the spiral axis, the plurality of conveying members configured to transfer the developer sequentially from a conveying member to an adjacent conveying member and including a first conveying member arranged at a position closest to the development member to supply developer to the development member, wherein a number of the spiral vanes of the first conveying member is at least two and is greater in number than the spiral vanes of a remaining conveying member.

2. The image forming apparatus according to claim 1, wherein the first conveying member includes an even number of spiral vanes each of which is regularly arranged at a position with an angle of 360 degree divided by the number of the spiral vanes.

3. The image forming apparatus according to claim 1, wherein a cross-sectional profile of the spiral vane of the first conveying member has an axisymmetrical shape with respect to the upstream and downstream direction of conveying the developer.

4. The image forming apparatus according to claim 1, wherein each of the plurality of conveying members includes a shaft member having the spiral vanes projected on a circumference of the shaft member, and wherein a diameter of the shaft member of the first conveying member is larger than a diameter of the shaft member of the remaining conveying member and a diameter of the spiral vane of the first conveying member is the same as a diameter of the spiral vane of the remaining conveying member.

5. The image forming apparatus according to claim 1, wherein a pitch of the spiral vane of the first conveying member in a direction of a shaft member is to be 0.3 to 0.7 times a pitch of the spiral vane of the remaining conveying member.

6. The image forming apparatus according to claim 1, wherein the first conveying member has a value of a bend elastic constant M (MPa) divided by a length of the first conveying member in a shaft direction, the value is more than 25.

7. The image forming apparatus according to claim 1, wherein a clearance between an edge of the spiral vane of the first conveying member and a wall of a developer storage is smaller than a clearance between an edge of the spiral vane of the remaining conveying member and a wall of a corresponding developer storage.

8. The image forming apparatus according to claim 1, further comprising:

a housing configured to hold the image carrier and the development unit and to be detachably attached in the image forming apparatus.

9. The image forming apparatus according to claim 1, wherein the image forming apparatus includes a plurality of development units each of which develops a latent image with a different color of toner.

10. An image forming apparatus, comprising:

an image carrier means for forming a latent image; and a development member means for developing the latent image forming on the image carrier with a developer, and a plurality of conveying members each including at least one spiral vane means for rotating around a spiral axis of the spiral vane to revolve and transfer the developer around the spiral axis in a direction along the spiral axis, the plurality of conveying members configured to transfer the developer sequentially from a conveying member to an adjacent conveying member and including a first conveying member arranged at a position closest to the development member to supply developer to the development member, wherein a number of the spiral vanes of the first conveying member is at least two and is greater in number than the spiral vanes of a remaining conveying member.

11. The image forming apparatus according to claim 10, wherein the first conveying member includes an even number of spiral vanes each of which is regularly arranged at a position with an angle of 360 degree divided by the number of the spiral vanes.

12. The image forming apparatus according to claim 10, wherein a cross-sectional profile of the spiral vane of the first conveying member has an axisymmetrical shape with respect to the upstream and downstream direction of conveying the developer.

13. The image forming apparatus according to claim 10, wherein a clearance between an edge of the spiral vane of the first conveying member and a wall of a developer storage is smaller than a clearance between an edge of the spiral vane of the remaining conveying member and a wall of a corresponding developer storage.

14. The image forming apparatus according to claim 10, wherein each of the plurality of conveying members includes a shaft member having the spiral vanes projected on a circumference of the shaft member, and wherein a diameter of the shaft member of the first conveying member is larger than a diameter of the shaft member of the remaining conveying member and a diameter of the spiral vane of the first conveying member is the same as a diameter of the spiral vane of the remaining conveying member.

15. The image forming apparatus according to claim 10, wherein the first conveying member has a value of a bend elastic constant M (MPa) divided by a length of the first conveying member in a shaft direction, the value is more than 25.

16. A development unit of an image forming apparatus, the apparatus having an image carrier for forming a latent image, the development unit comprising:

a development member configured to develop the latent image forming on the image carrier with a developer, and a plurality of conveying members each including at least one spiral vane and configured to rotate around a spiral axis of the spiral vane to revolve and transfer the developer around the spiral axis in a direction along the spiral axis, the plurality of conveying members configured to transfer the developer sequentially from a conveying member to an adjacent conveying member and including a first conveying member arranged at a position closest to the development member to supply developer to the development member, wherein a number of the spiral vanes of the first conveying member is at least two and is greater in number than the spiral vanes of a remaining conveying member.

17. The development unit according to claim 16, wherein the first conveying member includes an even number of spiral vanes each of which is regularly arranged at a position with an angle of 360 degree divided by the number of the spiral vanes.

18. The development unit according to claim 16, wherein a cross-sectional profile of the spiral vane of the first conveying member has an axisymmetrical shape with respect to the upstream and downstream direction of conveying the developer.

19. The development unit according to claim 16, wherein a clearance between an edge of the spiral vane of the first conveying member and a wall of a developer storage is smaller than a clearance between an edge of the spiral vane of the remaining conveying member and a wall of a corresponding developer storage.

20. The development unit according to claim 16, wherein each of the plurality of conveying members includes a shaft member having the spiral vanes projected on a circumference of the shaft member, and wherein a diameter of the shaft member of the first conveying member is larger than a diameter of the shaft member of the remaining conveying member and a diameter of the spiral vane of the first conveying member is the same as a diameter of the spiral vane of the remaining conveying member.

* * * * *